US007634204B2

(12) United States Patent
Ohta

(10) Patent No.: US 7,634,204 B2
(45) Date of Patent: Dec. 15, 2009

(54) EXCHANGE UNIT AND IMAGE FORMING APPARATUS HAVING THE SAME

(75) Inventor: Atsushi Ohta, Tokyo (JP)

(73) Assignee: Oki Data Corporation, Tokyo (JP)

( * ) Notice: Subject to any disclaimer, the term of this patent is extended or adjusted under 35 U.S.C. 154(b) by 384 days.

(21) Appl. No.: 11/657,527

(22) Filed: Jan. 25, 2007

(65) Prior Publication Data

US 2007/0177200 A1 Aug. 2, 2007

(30) Foreign Application Priority Data

Jan. 27, 2006 (JP) ..... 2006-018676

(51) Int. Cl.
*G03G 15/00* (2006.01)

(52) U.S. Cl. ..... 399/12

(58) Field of Classification Search ..... 399/12, 399/107, 111, 119

See application file for complete search history.

(56) References Cited

U.S. PATENT DOCUMENTS

2004/0120724 A1* 6/2004 Takiguchi ..... 399/12

FOREIGN PATENT DOCUMENTS

JP 2000-221866 8/2000

* cited by examiner

*Primary Examiner*—Hoang Ngo
(74) *Attorney, Agent, or Firm*—Kubotera & Associates, LLC

(57) ABSTRACT

An exchange unit to be detachably attached to an image forming apparatus includes an information holding unit for communicating with a communication unit disposed in the image forming apparatus to read or write information; a storage unit for retaining the information holding unit; a housing unit having an opening portion for inserting the information holding unit into the storage unit; and a lid member for opening and closing the opening portion.

19 Claims, 18 Drawing Sheets

EXCHANGE UNIT AND IMAGE FORMING APPARATUS HAVING THE SAME

BACKGROUND OF THE INVENTION AND RELATED ART STATEMENT

The present invention relates to an exchange unit and an image forming apparatus having the same.

In a conventional image forming apparatus such as a printer, a copier, and a facsimile, for example, a color printer, image forming units for each color are disposed. A toner cartridge is detachably attached to each of the image forming units as an exchange unit, so that the toner cartridge can be exchanged when toner is consumed. An information holding unit is attached to an outer frame of the toner cartridge for storing identification information such as toner color and the likes.

In the conventional toner cartridge, the information holding unit is attached to the outer frame thereof. Accordingly, when the toner cartridge contacts with other structure such as a main body of a printer (printer main body), a main body of the image forming unit (image forming unit main body), and the likes, external force may be applied to an attaching portion of the information holding unit, thereby causing the information holding unit to come off or be damaged.

In the conventional toner cartridge, the information holding unit is attached to the outer frame thereof. Accordingly, it is necessary to attach a memory member to the outer frame with strong adhesion to prevent the memory member constituting the information holding unit from shifting or coming off. As a result, when the toner cartridge is recycled, it is difficult to detach the memory member from the outer frame. On the other hand, when the memory member is attached to the outer frame with weak adhesion to easily detach the memory member from the outer frame upon recycling, the memory member easily shifts or comes off.

In view of the problems described above, an object of the present invention is to provide an exchange unit and an image forming apparatus, in which it is possible to solve the problems in the conventional toner cartridge. In particular, it is possible to prevent an information holding unit from coming off or being damaged.

Further objects and advantages of the invention will be apparent from the following description of the invention.

SUMMARY OF THE INVENTION

In order to attain the objects described above, according to one aspect of the present invention, an exchange unit is detachably attached to an image forming apparatus. The exchange unit includes an information holding unit for communicating with a communication unit disposed in the image forming apparatus to read or write information; a storage unit for retaining the information holding unit; a housing unit having an opening portion for inserting the information holding unit into the storage unit; and a lid member for opening and closing the opening portion.

In the present invention, the storage unit is disposed in the housing unit for retaining the information holding unit, and the lid member is provided for opening and closing the opening portion of the storage unit. Accordingly, the information holding unit does not contact with other structure such as a printer main body or other exchange unit attached to the printer main body. Therefore, it is possible to prevent the information holding unit from coming off or being damaged.

Further, in the present invention, it is not necessary to attach the information holding unit with a fixing method such as adhesion, fusion, and the likes. Accordingly, it is easy to detach the information holding unit from the storage unit, thereby improving recycle ability.

DETAILED DESCRIPTION OF PREFERRED EMBODIMENTS

Hereunder, embodiments of the present invention will be explained with reference to the accompanying drawings.

First Embodiment

Figure 2:
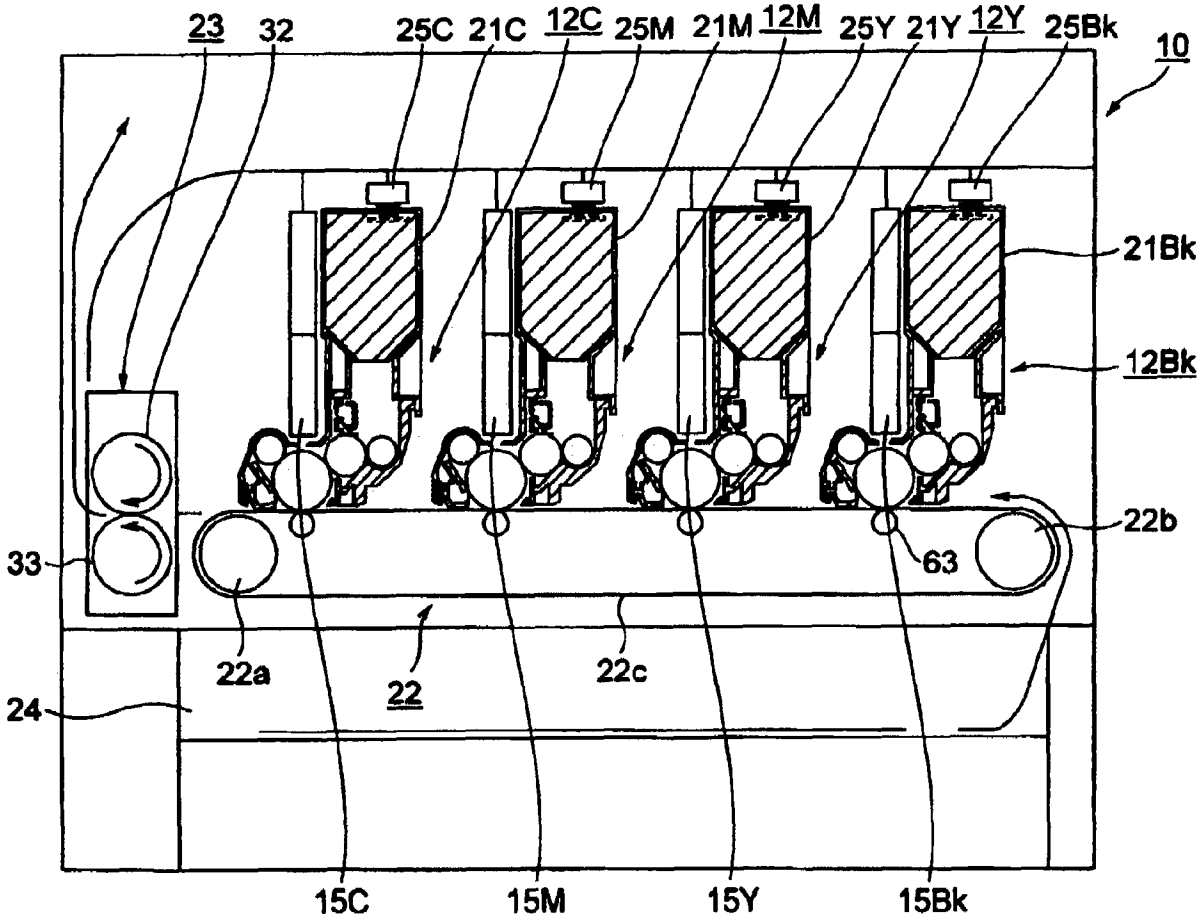
FIG. 2 is a schematic view showing a printer according to the first embodiment of the present invention.

FIG. 2 is a schematic view showing a printer 10 according to a first embodiment of the present invention. As shown in FIG. 2, the printer 10 includes four image forming units (developing units) 12Bk, 12Y, 12M, and 12C detachably attached to a printer main body as image forming devices; four LED heads 15Bk, 15Y, 15M, and 15C as exposure devices; a transfer unit 22 as a transportation/transfer device; a fixing unit 23 as a fixing device; a sheet supply cassette 24 as a medium storage section for storing sheets as recoding media; and four communication devices 25Bk, 25Y, 25M, and 25C.

The image forming units 12Bk, 12Y, 12M, and 12C include four toner cartridges 21Bk, 21Y, 21M, and 21C detachably attached to image forming unit main bodies as exchange units or developer storage units, respectively. When toner as developer is consumed and toner stored in the toner cartridges 21Bk, 21Y, 21M, and 21C is decreased, the toner cartridges 21Bk, 21Y, 21M, and 21C are exchanged.

Each of the image forming units 12Bk, 12Y, 12M, and 12C, the transfer unit 22, the fixing unit 23, and the sheet supply cassette 24 is an exchange unit detachably exchangeable relative to the printer main body. Each unit may be exchanged, for example, when a component thereof wears.

The image forming units 12Bk, 12Y, 12M, and 12C are capable of forming images in black, yellow, magenta, and cyan with an image forming method of electronic photography type, respectively. The image forming units 12Bk, 12Y, 12M, and 12C are arranged in order from a supply side to a discharge side of a sheet. Toner in each color is stored in the toner cartridges 21Bk, 21Y, 21M, and 21C, respectively, thereby supplying toner to the image forming units 12Bk, 12Y, 12M, and 12C.

The transfer unit 22 includes a drive roller 22*a* as a first roller; an idle roller 22*b* as a second roller; a belt 22*c* placed between the drive roller 22*a* and the idle roller 22*b* as a transport member; and transfer rollers 63 as transfer members disposed to face the image forming units 12Bk, 12Y, 12M, and 12C. The fixing unit 23 includes a heat roller 32 as a heating member and a backup roller 33 as a pressing member.

Next, the image forming units 12Bk, 12Y, 12M, and 12C will be explained in more detail. Each of the image forming units 12Bk, 12Y, 12M, and 12C has an identical structure. Accordingly, only the image forming unit 12Bk will be explained.

Figure 3:
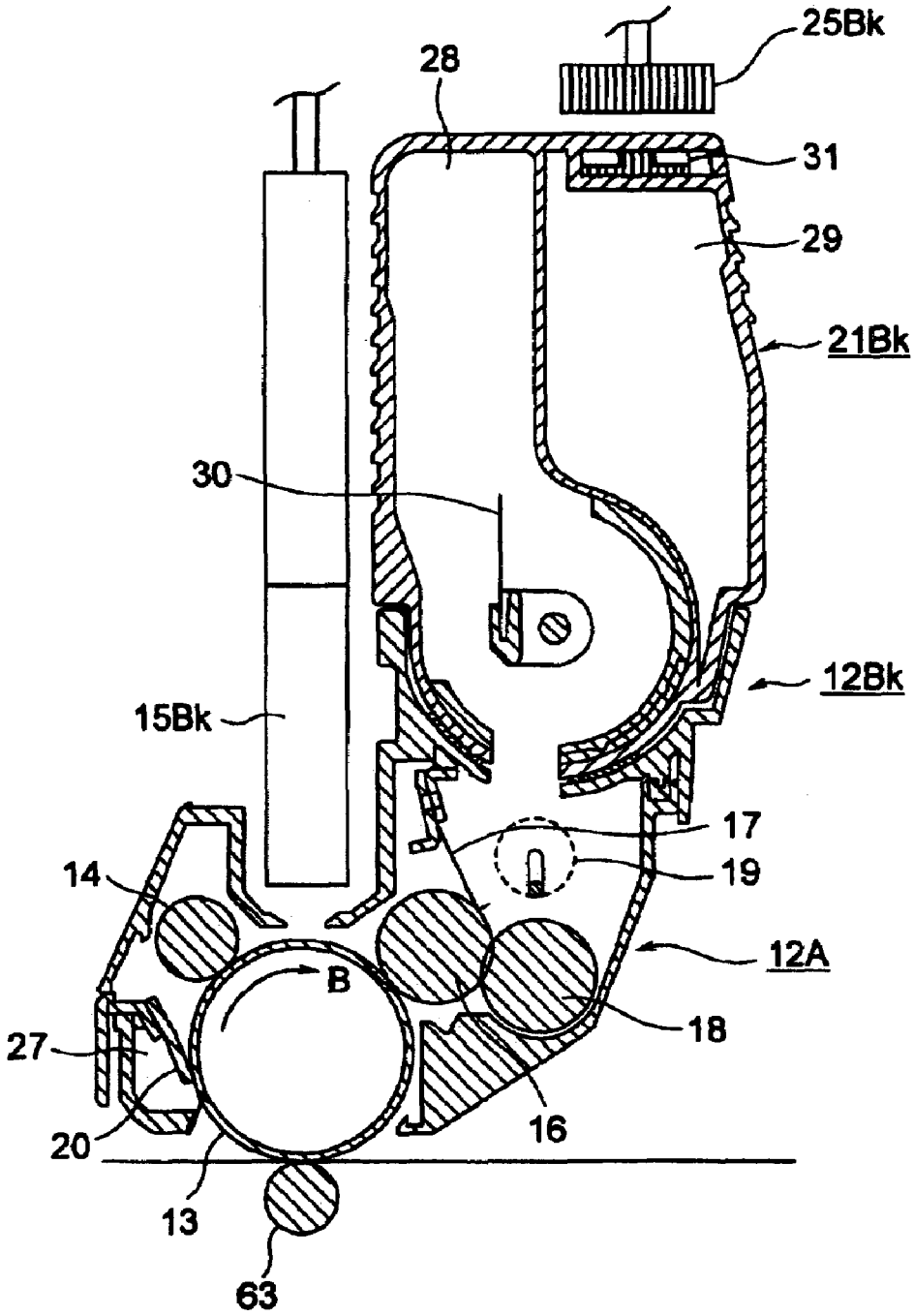
FIG. 3 is a schematic view showing an image forming unit according to the first embodiment of the present invention.

FIG. 3 is a schematic view showing the image forming unit 12Bk according to the first embodiment of the present invention.

As shown in FIG. 3, the image forming unit 12Bk is formed of an image forming unit main body 12A and the toner cartridge 21Bk. The image forming unit main body 12A includes a photosensitive drum 13 as an image supporting member having a photosensitive layer; a charging roller 14 as a charging device for uniformly charging a surface of the photosensitive drum 13; a developing roller 16 as a developer supporting member; a sponge roller 18 as a developer supply member for supplying toner with a constant amount to the developing roller 16; a toner stirring member 19 as a developer stirring member disposed in a developing section; a developing blade 17 for forming a uniform toner layer as a uniform developer layer on the developing roller 16; a cleaning blade 20 as a cleaning device formed of an elastic member; and a toner waste collector 27 for temporarily storing toner waste scraped off by the cleaning blade 20.

The toner cartridge 21Bk includes a toner storage unit 28 as a first storage unit for storing toner to be supplied to the image forming unit main body 12A; a toner waste storage unit 29 as a second storage unit for storing toner waste; a toner supply member 30 for stably supplying toner to the image forming unit main body 12A; and an RFID tag 31 as an information holding unit or a memory member. The RFID tag 31 includes a board unit for communicating with the communication unit 25Bk of the printer main body to read and write information related to the image forming unit 12Bk.

The photosensitive drum 13 rotates in an arrow direction B. The charging roller 14 is disposed to contact with the photosensitive drum 13, so that the charging roller 14 rotates following with the photosensitive drum 13 to uniformly charge the surface of the photosensitive drum 13 with a voltage applied to the charging roller 14. When the LED head 15Bk disposed on the printer main body to face the photosensitive drum 13 irradiates LED light toward the photosensitive drum 13 according to image information, a static latent image is formed on the surface of the photosensitive drum 13 as a latent image.

The toner stirring member 19 rotates to stir toner in the developing section. The sponge roller 18 contacts with the developing roller 16 and rotates for supplying toner with a constant amount to the developing roller 16. The developing roller 16 supplies toner to a developing area of the photosensitive drum 13 to develop the static latent image formed on the photosensitive drum 13, thereby forming a toner image to visualize the static latent image. The developing blade 17 forms the toner layer with a uniform thickness charged through friction charging on a surface of the developing roller 16.

The transfer roller 63 transfers the toner image formed on the photosensitive drum 13 to a sheet transported from the sheet supply cassette 24. At this time, the cleaning blade 20 disposed to abut against the photosensitive drum 13 scrapes off toner not transferred and remaining on the photosensitive drum 13, so that toner waste is collected in the toner waste collector 27. Toner waste collected in the toner waste collector 27 is transported with a transporting member (not shown) to the toner waste storage unit 29 of the toner cartridge 21Bk and collected therein. In the first embodiment, the toner waste storage unit 29 is disposed in the toner cartridge 21Bk, and may be disposed in the printer main body.

After the image forming units 12Bk, 12Y, 12M, and 12C form the toner images in each color, the transfer rollers 63 sequentially transfer the toner images on the sheet transported with the belt 22*c*, thereby forming a color toner image on the sheet. Afterward, the sheet is transported to the fixing unit 23, so that the fixing unit 23 fixes the toner image to the sheet, thereby forming a color image. Then, the sheet is discharged with a discharge roller (not shown).

Figure 4:
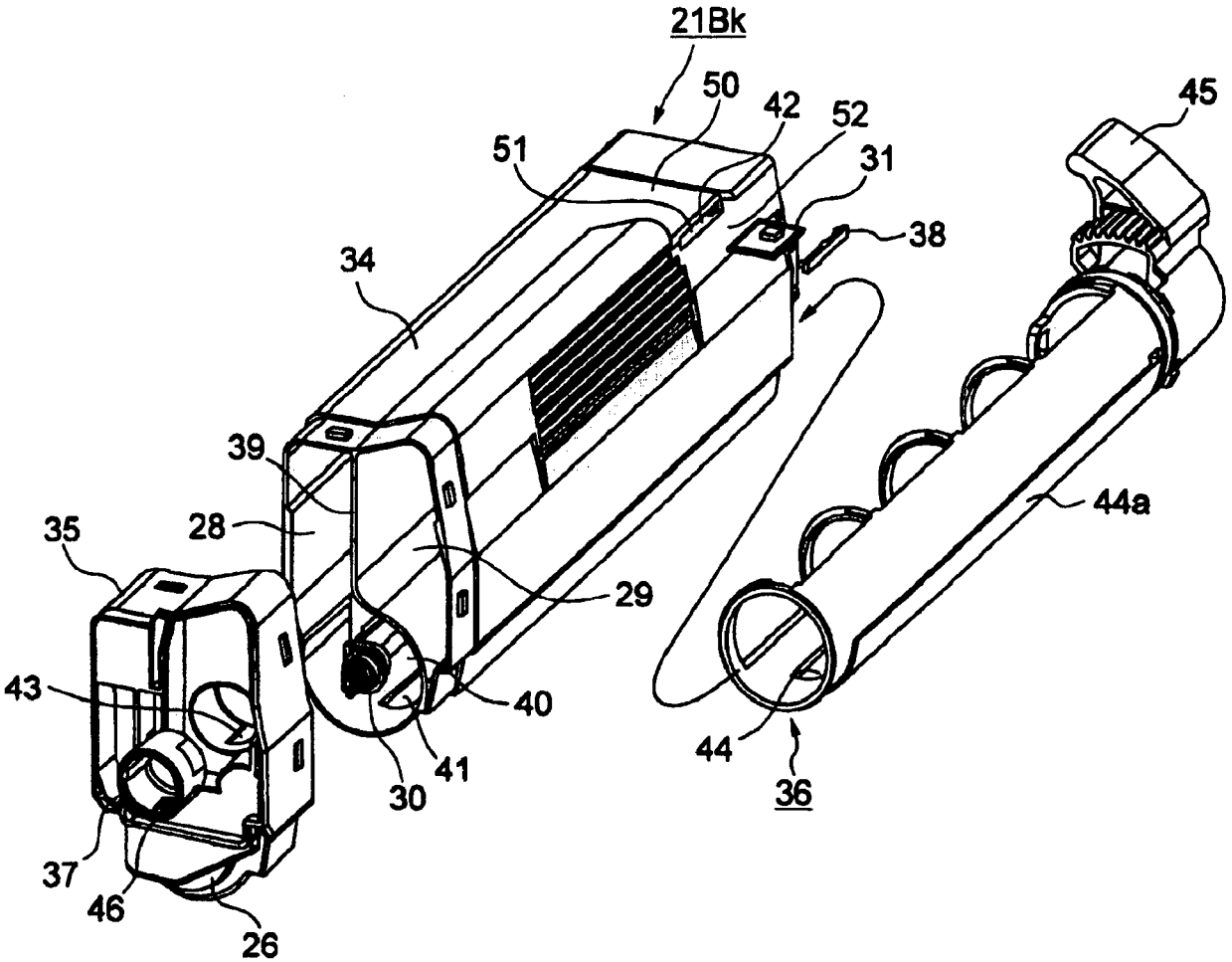
FIG. 4 is a schematic exploded perspective view showing a toner cartridge according to the first embodiment of the present invention.
Figure 5:
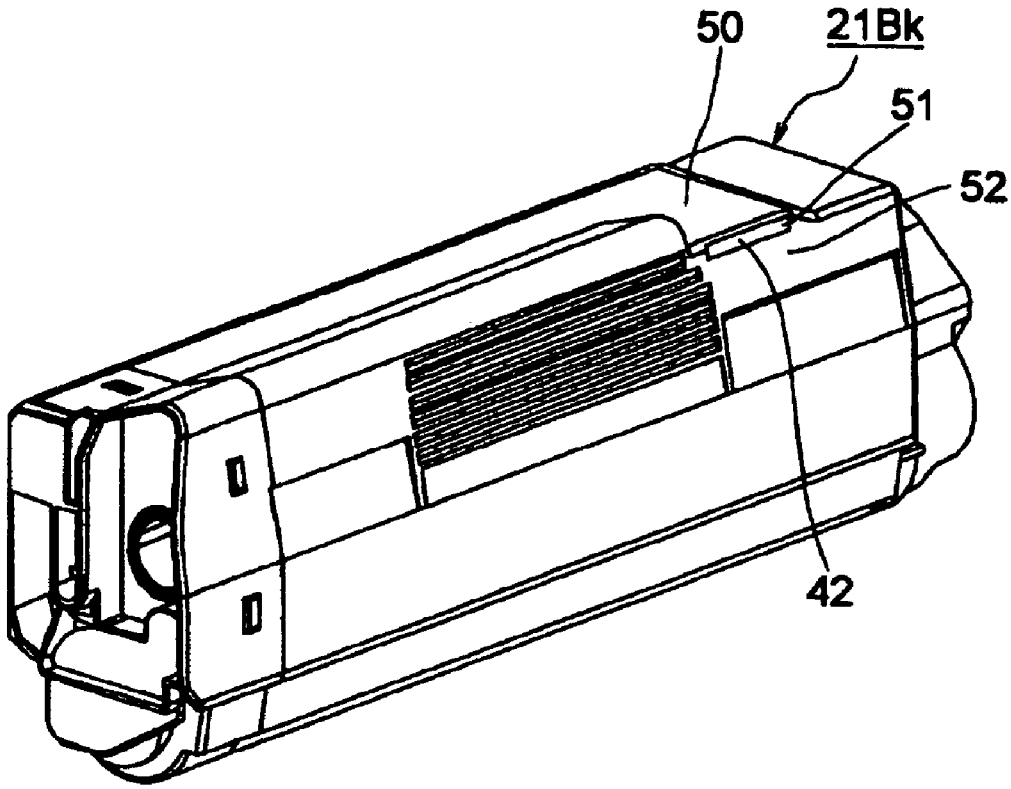
FIG. 5 is a schematic perspective view showing the toner cartridge according to the first embodiment of the present invention.

The toner cartridge 21Bk will be explained in more detail next. FIG. 4 is a schematic exploded perspective view showing the toner cartridge 21Bk according to the first embodiment of the present invention. FIG. 5 is a schematic perspective view showing the toner cartridge 21Bk according to the first embodiment of the present invention.

As shown in FIGS. 4 and 5, the toner cartridge 21Bk includes an outer frame 34 as a first housing unit; a side frame 35 as a second housing section; a toner supply opening closing member 36 as a developer supply opening closing member; a toner waste collection opening closing member 37 as a developer waste collection opening closing member; a toner supply member 30 for stabilizing an amount of toner supplied to the image forming unit 12Bk; the RFID tag 31 for storing information related to the toner cartridge 21Bk and exchanging information with the communication device 25Bk; a storage unit 42 for receiving the RFID tag 31; and a lid member 38 for opening and closing an opening portion 51 of the storage unit 42.

In the outer frame 34, a partition plate 39 is integrated with the outer frame 34 for defining a border between the toner storage unit 28 and the toner waste storage unit 29. A cylindrical space 40 is formed at a lower portion of the toner storage unit 28. A toner supply opening 41 is formed in the toner storage unit 28 for communicating with the image forming unit main body 12A (a portion of the image forming unit 12Bk other than the toner cartridge 21Bk). A top wall 50 is formed at an upper top portion of the outer frame 34 as an opposing surface or a surface facing the communication device 25Bk of the printer main body. The opening portion 51 is formed in a sidewall 52 adjacent to the top wall 50 for inserting the RFID tag 31 into the storage unit 42.

The storage unit 42 is arranged substantially in parallel to the top wall 50 to extend from the opening portion 51 toward inside the toner cartridge 21Bk, and is integrated with the outer frame 34 (the top wall 50 and the sidewall 52). When the outer frame 34 is molded using a resin, a mold has a protruding portion having a shape corresponding to that of the storage unit 42. The side frame 35 engages the outer frame 34, and includes a toner waste collection opening 43 communicating with the toner waste storage unit 29 as a developer waste collection opening having a cylindrical shape.

The toner supply opening closing member 36 is disposed in the cylindrical space 40 of the outer frame 34 to be freely rotatable therein, and is provided with an opening portion 44 at a lower portion thereof. When an operator operates an operation lever 45 disposed on one end portion of the toner supply opening closing member 36 to rotate the toner supply opening closing member 36, it is possible to open the toner supply opening 41 through aligning the toner supply opening 41 with the opening portion 44, or close the toner supply opening 41 through shifting the toner supply opening 41 from the opening portion 44. A seal sponge 44*a* is disposed around the opening 44 for preventing toner from entering between the toner supply opening closing member 36 and the cylindrical space 40 and leaking from the toner supply opening 41.

The toner waste collection opening closing member 37 is disposed in the side frame 35 to be freely rotatable therein, and is provided with an opening portion 46 at a lower portion thereof. When the toner waste collection opening closing member 37 rotates, it is possible to open the toner waste collection opening 43 through aligning the toner waste collection opening 43 with the opening portion 46, or close the toner waste collection opening 43 through shifting the toner waste collection opening 43 from the opening portion 46.

The toner supply member 30 is disposed in the cylindrical space 40 to be freely rotatable. The toner supply member 30 is connected to a drive unit (not shown) disposed on the printer main body through a gear 26 disposed on one end portion of the toner supply member 30 for driving the toner supply member 30, so that the drive unit is driven to rotate the toner supply member 30.

When the toner supply member 30 rotates, toner discharged from the toner supply opening 41 is directly supplied to the image forming unit main body 12A. Note that a sponge member (not shown) is disposed as a seal member at each of engagement portions of the components constituting the toner cartridge 21Bk, so that toner does not leak from a gap of each of the engagement portions.

Figure 1:
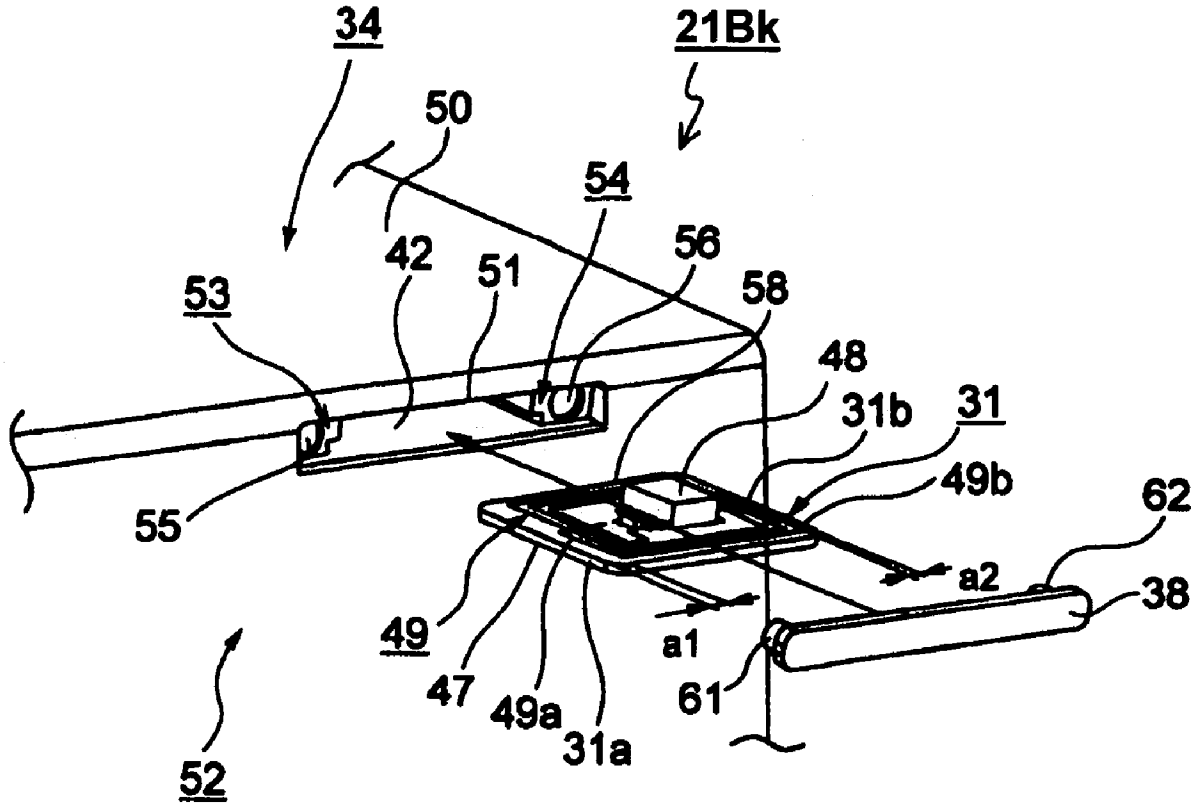
FIG. 1 is a schematic exploded perspective view showing a method of attaching an RFID tag according to a first embodiment of the present invention.

A method of attaching the RFID tag 31 will be explained next. FIG. 1 is a schematic exploded perspective view showing a method of attaching the RFID tag 31 according to the first embodiment of the present invention.

Figure 6:
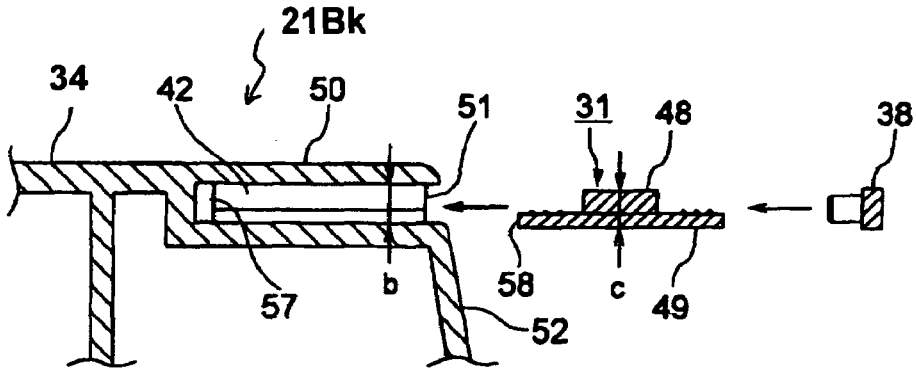
FIG. 6 is a schematic view (No. 1) showing the method of attaching the RFID tag according to the first embodiment of the present invention.
Figure 7:
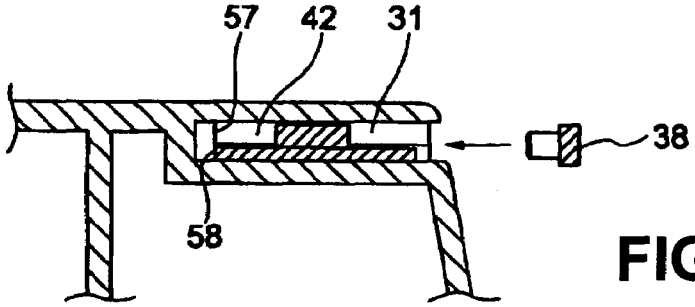
FIG. 7 is a schematic view (No. 2) showing the method of attaching the RFID tag according to the first embodiment of the present invention.
Figure 8:
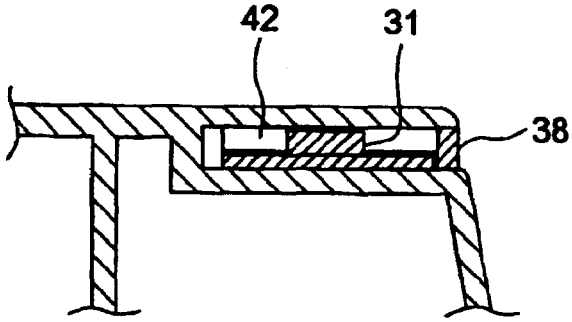
FIG. 8 is a schematic view (No. 3) showing the method of attaching the RFID tag according to the first embodiment of the present invention.

Further, FIG. 6 is a schematic view (No. 1) showing the method of attaching the RFID tag 31 according to the first embodiment of the present invention. FIG. 7 is a schematic view (No. 2) showing the method of attaching the RFID tag 31 according to the first embodiment of the present invention. FIG. 8 is a schematic view (No. 3) showing the method of attaching the RFID tag 31 according to the first embodiment of the present invention.

Figure 9:
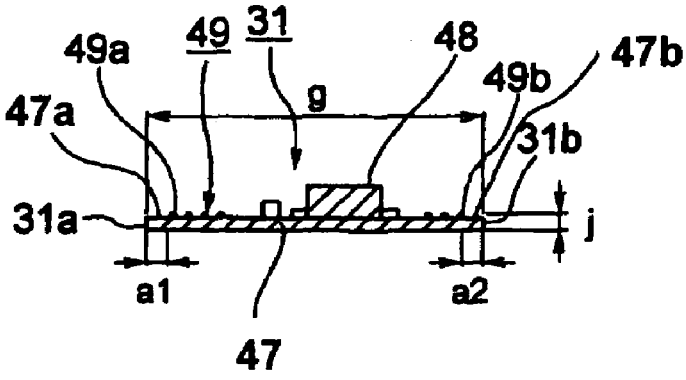
FIG. 9 is a schematic sectional view showing the RFID tag according to the first embodiment of the present invention.
Figure 10:
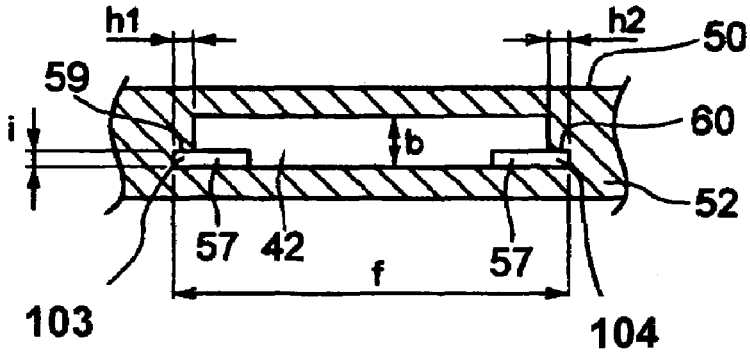
FIG. 10 is a schematic front view showing a storage unit according to the first embodiment of the present invention.
Figure 11:
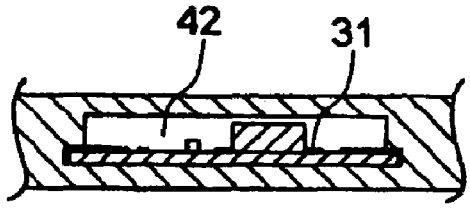
FIG. 11 is a schematic view showing an attachment state of the RFID tag according to the first embodiment of the present invention.

Further, FIG. 9 is a schematic sectional view showing the RFID tag 31 according to the first embodiment of the present invention. FIG. 10 is a schematic front view showing the storage unit according to the first embodiment of the present invention. FIG. 11 is a schematic view showing an attachment state of the RFID tag 31 according to the first embodiment of the present invention.

Figure 12:
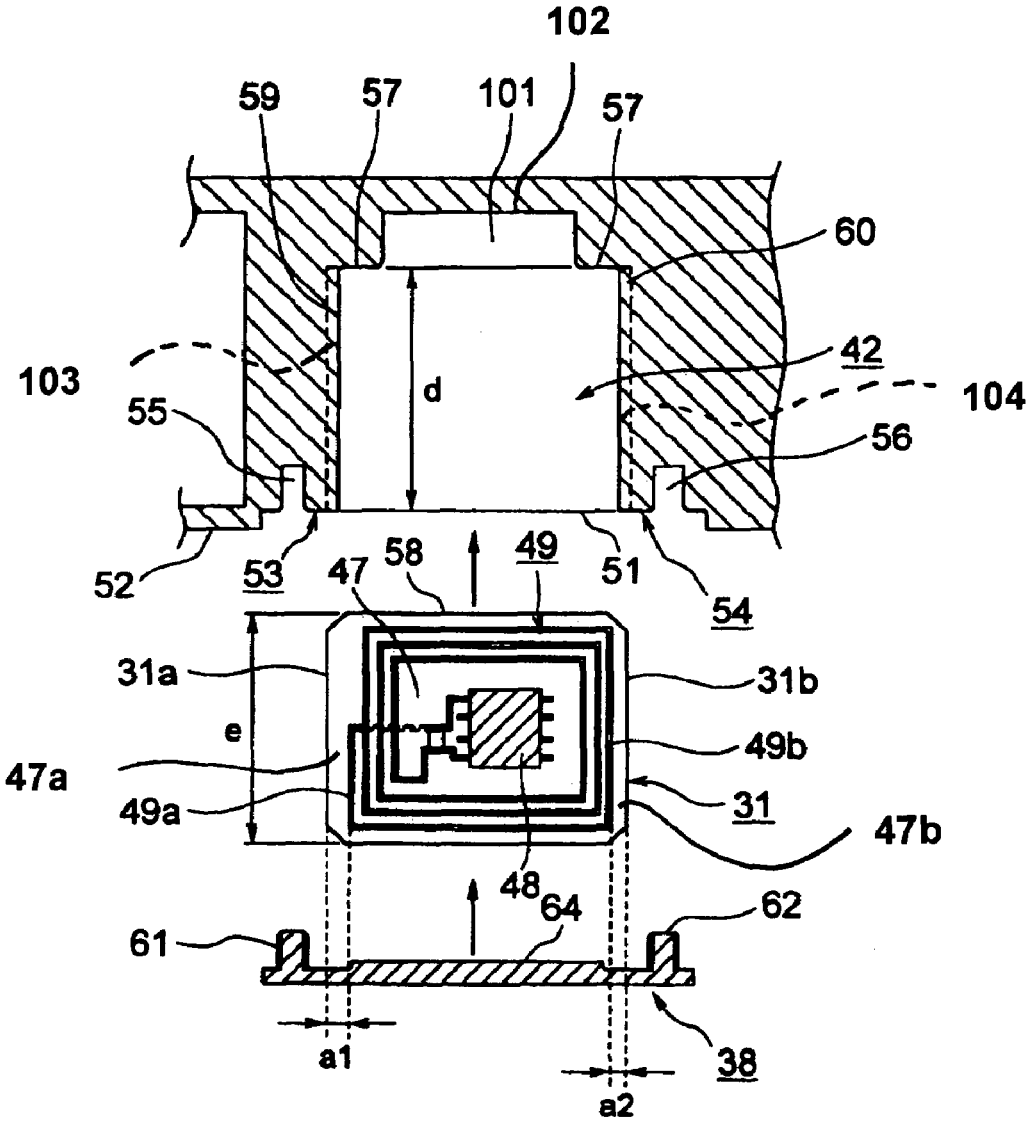
FIG. 12 is a schematic plan view showing the method of attaching the RFID tag according to the first embodiment of the present invention.
Figure 13:
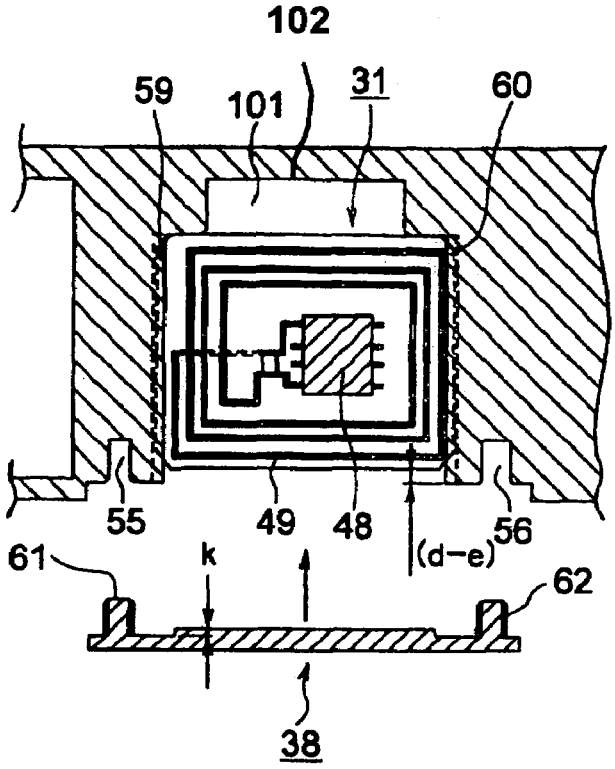
FIG. 13 is a schematic view (No. 1) showing a method of attaching a lid member according to the first embodiment of the present invention.
Figure 14:
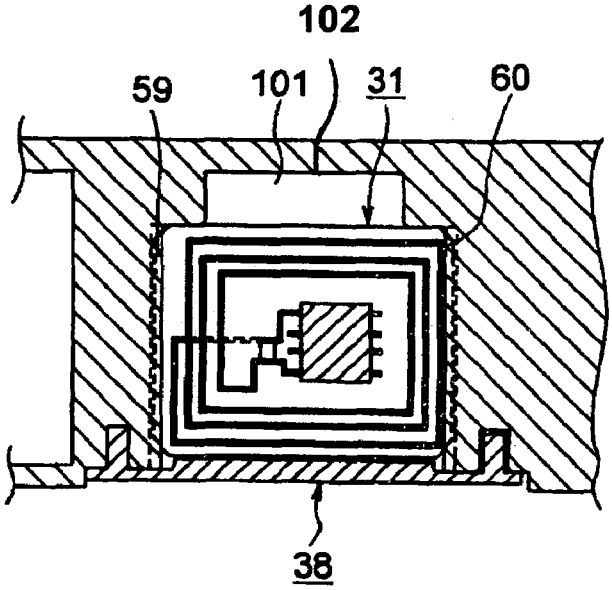
FIG. 14 is a schematic view (No. 2) showing the method of attaching the lid member according to the first embodiment of the present invention.

Further, FIG. 12 is a schematic plan view showing the method of attaching the RFID tag according to the first embodiment of the present invention. FIG. 13 is a schematic view (No. 1) showing a method of attaching the lid member according to the first embodiment of the present invention. FIG. 14 is a schematic view (No. 2) showing the method of attaching the lid member according to the first embodiment of the present invention.

As shown in FIG. 1, the outer frame 34 of the toner cartridge 21Bk has the opening portion 51 of the storage unit 42 in the sidewall 52 of the top wall 50 facing the communication device 25Bk. The RFID tag 31 is inserted while sliding through the opening portion 51, so that the RFID tag 31 is set at a position facing the communication device 25Bk. The lid member 38 is detachably attached to the outer frame 34 for opening and closing the opening portion 51.

The RFID tag 31 includes a base member 47 having a rectangular shape; a memory element 48 disposed on the base member 47 as a memory member with the information of the toner cartridge 21Bk stored therein; and an antenna circuit pattern 49 as a communication element or circuit pattern for sending and receiving the information to and from the communication device 25Bk.

The antenna circuit pattern 49 is disposed around the memory element 48 arranged substantially at a center of the base member 47, and is formed of a conductive pattern with a coil shape extending outward with the memory element 48 as a center thereof. It is preferred that the antenna circuit pattern 49 has outermost circumference portions 49*a* and 49*b* situated inside away from end portions 31*a* and 31*b* of the base member 47 by 0.5 mm or greater at both left and right sides relative to an insertion direction of the RFID tag 31.

Accordingly, when a distance between the end portion 31*a* of the RFID tag 31 (left side in FIGS. 1 and 12) and the outermost circumference portion 49*a* of the antenna circuit pattern 49 is designated by a1, and a distance between the end portion 31*b* of the RFID tag 31 (right side in FIGS. 1 and 12) and the outermost circumference portion 49*b* of the antenna circuit pattern 49 is designated by a2, the distances a1 and a2 are set to be 0.5 mm or greater (for example, a1=1.5 mm, a2=1 mm). In other words, a base member outer circumference 47*a* between the outermost circumference portion 49*a* of the antenna circuit pattern 49 and the end portion 31*a* of the RFID tag 31, and a base member outer circumference 47*b* between the outermost circumference portion 49*b* of the antenna circuit pattern 49 and the end portion 31*b* of the RFID tag 31 have a width of 0.5 mm or greater.

As shown in FIG. 6, the storage unit 42 is arranged in parallel to the top wall 50 facing the communication device 25Bk, and the opening portion 51 is formed in the sidewall 52 adjacent to a side surface of the top wall 50. The storage unit 42 has a height b greater than a height c of the RFID tag 31 (for example, b=2.8 mm, c=2.5 mm).

As shown in FIG. 12, flat portions 53 and 54 and pin grooves 55 and 56 are formed around the opening portion 51 for abutting against the lid member 38. A depth d of the storage unit 42 from the flat portions 53 and 54 is equal to or greater than a length e of the RFID tag 31 in the insertion direction thereof (for example, d=15.7 mm, e=15 mm). Accordingly, the RFID tag 31 is inserted into the storage unit 42 until a front end surface 58 abuts against backside surfaces 57 protruding from a furthermost backside of the storage unit 42 as abutting portions.

When the RFID tag 31 is inserted into the storage unit 42, a recess portion 101 is formed between a furthermost backside surface 102 of the storage unit 42 and the front end surface 58 of the RFID tag 31, so that the backside surface 102 does not contact with the RFID tag 31. That is, the front end surface 58 abuts against the backside surfaces 57 for positioning the RFID tag 31. In this case, only the backside surfaces 57 abutting against the front end surface 58 need to have high dimensional accuracy for improving positioning accuracy of the RFID tag 31.

As shown in FIGS. 10 and 12, guide ribs 59 and 60 are situated inside the storage unit 42 as fixing portions along both sidewalls of the storage unit 42. The base member outer circumferences 47*a* and 47*b* of the base member 47, where the antenna circuit pattern 49 is not disposed, are inserted into grooves 103 and 104 formed below the guide ribs 59 and 60, thereby fixing and supporting the RFID tag 31 inside the storage unit 42.

In the embodiment, a dimensional relationship of the storage unit 42 and the RFID tag 31 is as follows:

$$g \leqq f \leqq g + 0.5 \text{ mm}$$

where f is a width of the toner supply opening 41 and g is a width of the RFID tag 31 (for example, f=20.4 mm, g=20 mm). Further, when the guide ribs 59 and 60 have widths h1 and h2, h1 is equal to or less than a1 and h2 is equal to or less than a2 (for example, h1=1 mm, h2=1 mm). Further, a dimensional relationship of the RFID tag 31 and the guide ribs 59 and 60 is as follows:

$$j \leqq i \leqq j + 0.2 \text{ mm}$$

where i is a height of the guide ribs 59 and 60 and j is a thickness of the RFID tag 31 (for example, i=0.9 mm, j=0.75 mm).

The lid member 38 is attached to the outer frame 34 after the RFID tag 31 is inserted. As shown in FIG. 12, the lid member 38 is provided with pressing pins 61 and 62 corresponding to the pin grooves 55 and 56. The pressing pins 61 and 62 and the pin grooves 55 and 56 constitute the fixing portions.

A center portion 64 of the lid member 38 has an enough thickness such that a rear end surface of the RFID tag 31 does not contact with the center portion 64 in an inserted state. That is, the center portion 64 of the lid member 38 facing the RFID tag 31 protrudes toward the RFID tag 31 up to a point where the rear end surface of the RFID tag 31 does not contact with the center portion 54. Accordingly, it is possible to minimize a gap between the lid member 38 and the RFID tag 31, thereby reducing wobble of the RFID tag 31. A dimensional relationship of the RFID tag 31 and the center portion 64 is as follows:

$$(d-e) - 0.5 \text{ mm} \leqq k \leqq (d-e)$$

where k is a thickness of the center portion 64, d is the depth of the storage unit 42, and e is the length e of the RFID tag 31 in the insertion direction thereof.

An operation of inserting the RFID tag 31 into the storage unit 42 and setting the RFID tag 31 will be explained next. First, the RFID tag 31 slides and is inserted into the storage unit 42 in an arrow direction shown in FIG. 12, so that the RFID tag 31 advances until the end surface 58 abuts against the backside surfaces 57. Then, the pressing pins 61 and 62 are fitted into the pin grooves 55 and 56 of the storage unit 42, and the lid member 38 is pushed such that the lid member 38 abuts against the flat portions 53 and 54. Accordingly, it is possible to set the RFID tag 31 in the storage unit 42.

As described above, in the first embodiment, the RFID tag 31 is set in the storage unit 42 formed in the toner cartridge 21Bk, and the lid portion 38 closes the opening portion 51. Accordingly, the RFID tag 31 does not contact with other structure such as the printer main body and the image forming unit main body 12A. As a result, the RFID tag 31 does not come off or is not damaged.

Further, it is not necessary to attach the RFID tag 31 to the surface of the toner cartridge 21Bk with a fixing method such as adhesion, fusion, and the likes. Accordingly, the RFID tag 31 does not come off or is not damaged. Also, the RFID tag 31 is set in the storage unit 42 formed in the toner cartridge 21Bk, and the lid portion 38 closes the opening portion 51. Accordingly, it is possible to prevent the memory element 48 from shifting or coming off. Further, it is easy to detach the RFID tag 31 from the storage unit 42, thereby improving recycle ability.

Second Embodiment

A second embodiment of the present invention will be explained next. In the second embodiment, each of the image forming units 12Bk, 12Y, 12M, and 12C is formed of an integrated structure of the image forming unit main body and the toner cartridge, and is disposed as the exchange unit. In the description below, elements in the second embodiment same as those in the first embodiment are designated by same reference numerals, and explanations thereof are omitted. The elements same as those in the first embodiment provide same effects. Further, each of the image forming units 12Bk, 12Y, 12M, and 12C has an identical structure. Accordingly, only the image forming unit 12Bk will be explained.

Figure 15:
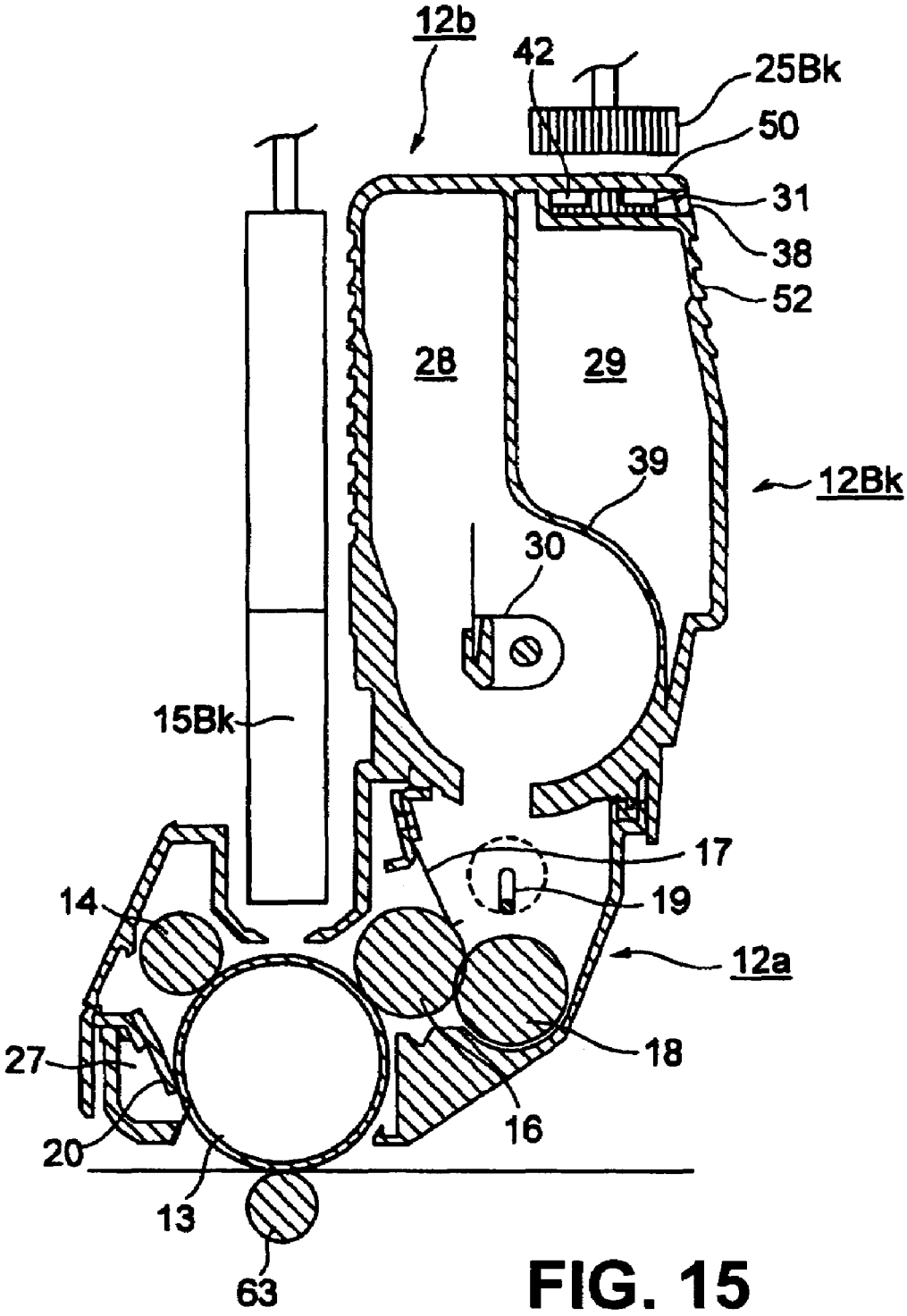
FIG. 15 is a schematic view showing an image forming unit according to a second embodiment of the present invention.

FIG. 15 is a schematic view showing the image forming unit 12Bk according to the second embodiment of the present invention. As shown in FIG. 15, an image forming unit main body 12*a* and a toner storage unit 12*b* as a developer storage unit are integrated to form the image forming unit 12Bk. The RFID tag 31 is disposed in the toner storage unit 12*b*.

Third Embodiment

A third embodiment of the present invention will be explained next. In the third embodiment, an RFID tag 70 is attached to the fixing unit 23. In the description below, elements in the third embodiment same as those in the first embodiment are designated by same reference numerals, and explanations thereof are omitted. The elements same as those in the first embodiment provide same effects. A basic configuration of the printer is the same as that in the first embodiment.

Figure 16:
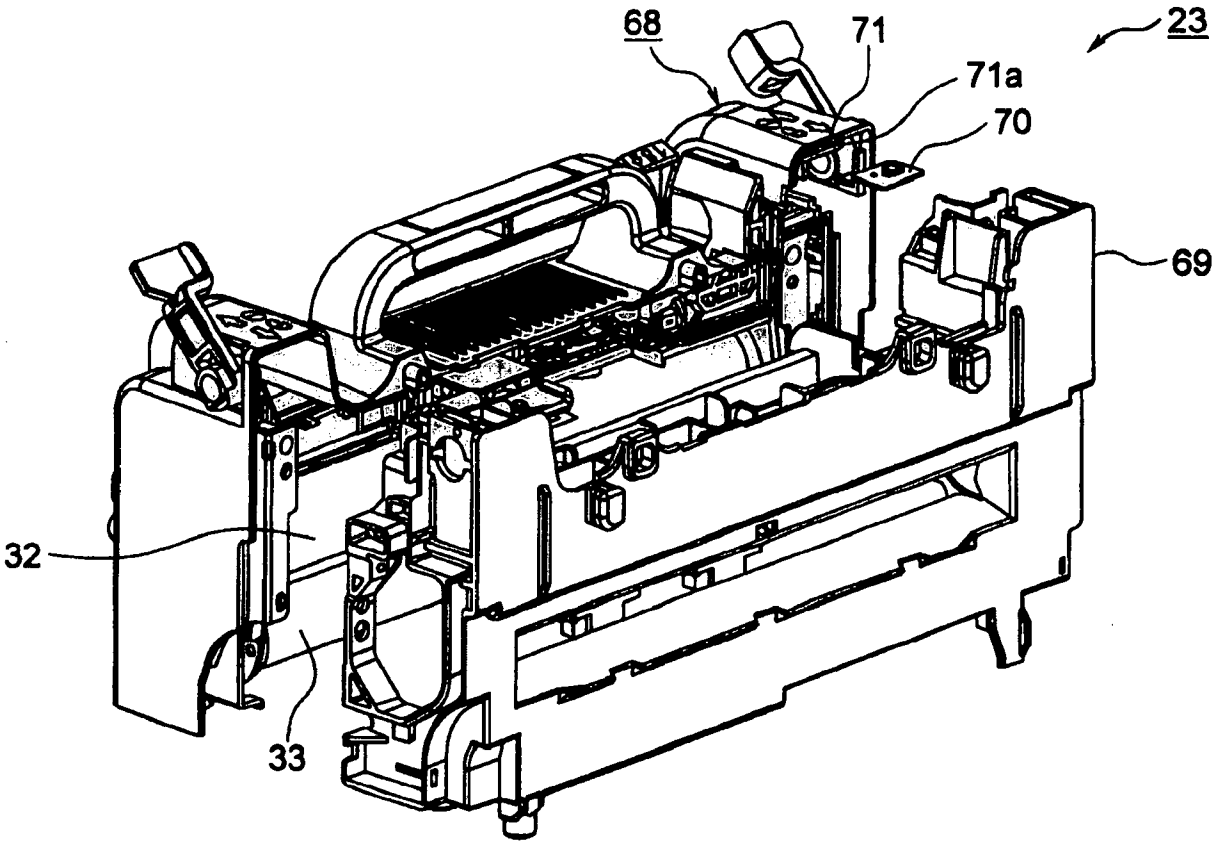
FIG. 16 is a schematic exploded perspective view showing a fixing unit according to a third embodiment of the present invention.
Figure 17:
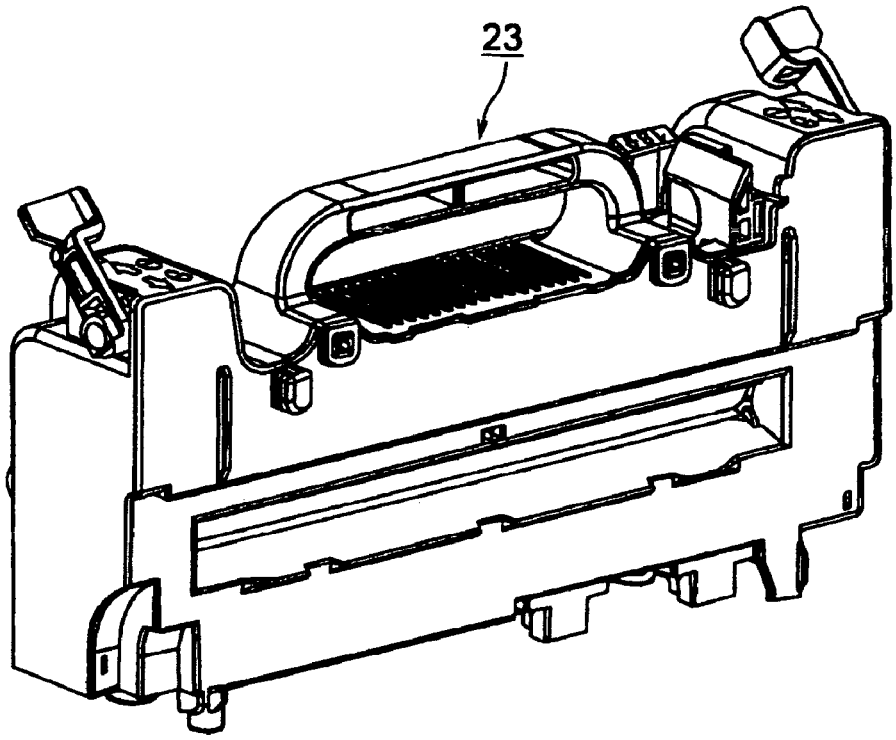
FIG. 17 is a schematic perspective view showing the fixing unit according to the third embodiment of the present invention.

FIG. 16 is a schematic exploded perspective view showing the fixing unit 23 according to the third embodiment of the present invention. FIG. 17 is a schematic perspective view showing the fixing unit 23 according to the third embodiment of the present invention.

As shown in FIG. 16, the fixing unit 23 includes a rear frame 68 as a first housing unit surrounding a fixing mechanism such as the heat roller 32 and the backup roller 33; and a front frame 69 as a second housing unit for engaging the rear frame 68 through latch engagement. An opening portion 74*a* is formed in the rear frame 68 at an upper portion thereof for inserting the RFID tag 70 into a storage unit 71.

Figure 18:
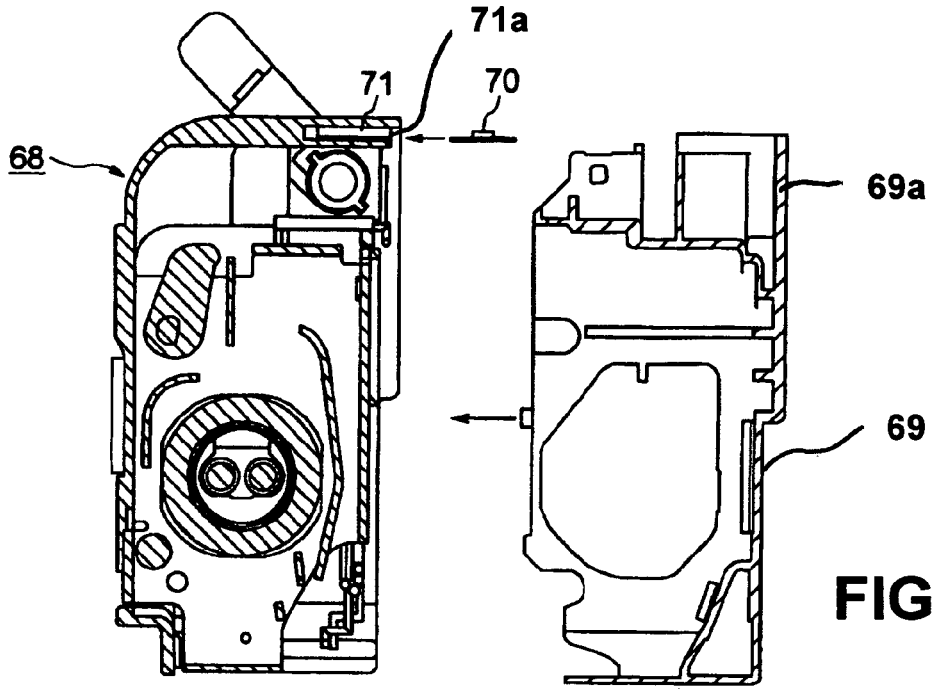
FIG. 18 is a schematic view (No. 1) showing a method of attaching the RFID tag according to the third embodiment of the present invention.
Figure 19:
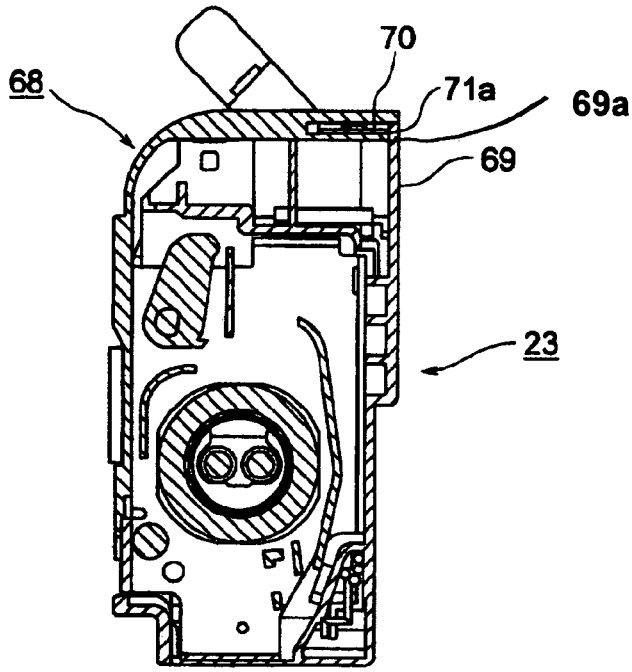
FIG. 19 is a schematic view (No. 2) showing the method of attaching the RFID tag according to the third embodiment of the present invention.

An operation of inserting the RFID tag 70 into the storage unit 71 will be explained next. FIG. 18 is a schematic view (No. 1) showing a method of attaching the RFID tag 70 according to the third embodiment of the present invention. FIG. 19 is a schematic view (No. 2) showing the method of attaching the RFID tag 70 according to the third embodiment of the present invention.

As shown in FIGS. 18 and 19, after the RFID tag 70 is inserted into the storage unit 71, the front frame 69 engages the rear frame 68 through latch engagement, so that the front frame 69 closes the opening portion 71*a*. That is, a part of the front frame 69 functions as a closing member 69*a* or lid member for closing the opening portion 71*a*.

As described above, in the third embodiment, the RFID tag 70 is set in the storage unit 71 in the rear frame 68, and the front frame 69 closes the opening portion 71*a*. Accordingly, the RFID tag 70 does not contact with other structure such as the printer main body and the image forming unit main body. Therefore, the RFID tag 70 does not come off or is not damaged.

Fourth Embodiment

A fourth embodiment of the present invention will be explained next. In the description below, elements in the fourth embodiment same as those in the first and second embodiments are designated by same reference numerals, and explanations thereof are omitted. The elements same as those in the first and second embodiments provide same effects.

Figure 20:
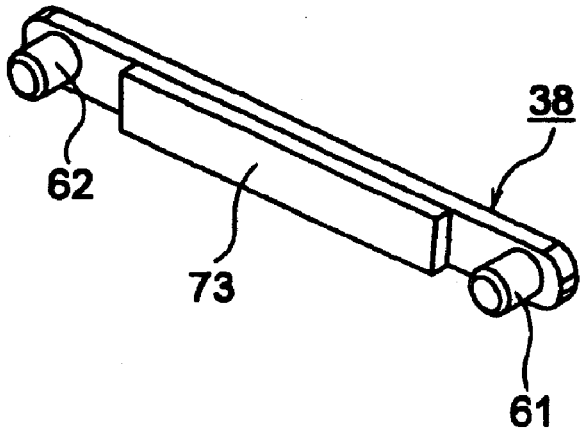
FIG. 20 is a schematic perspective view showing a lid member according to a fourth embodiment of the present invention.
Figure 21:
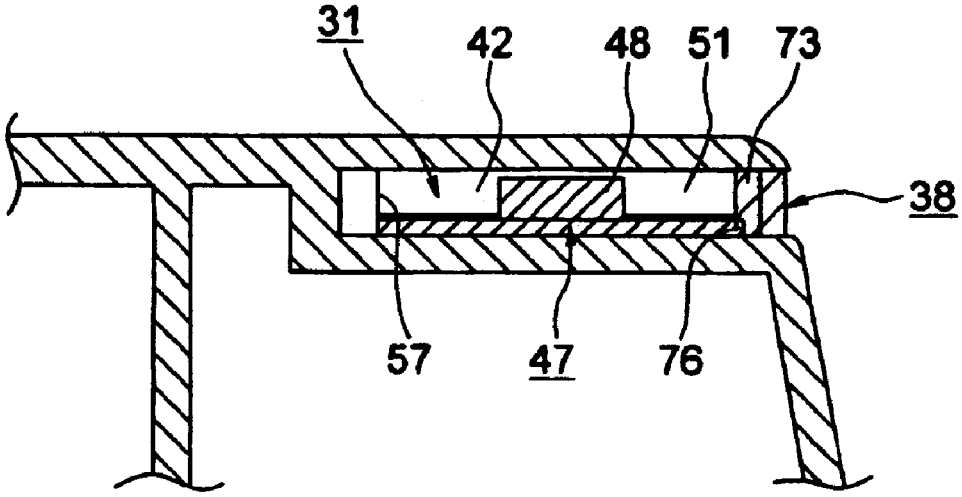
FIG. 21 is a schematic view showing an attachment state of the lid member according to the fourth embodiment of the present invention.

FIG. 20 is a schematic perspective view showing a lid member according to the fourth embodiment of the present invention. FIG. 21 is a schematic view showing an attachment state of the lid member according to the fourth embodiment of the present invention.

As shown in FIGS. 20 and 21, the lid member 38 to be attached to the opening portion 51 of the storage unit 42 is provided with a sponge member 73 as a deformable member or an elastic member on an inner surface thereof over a specific length. The sponge member 73 has a thickness such that the sponge member 73 interferes with a rear edge 76 of the base member 47 of the RFID tag 31 when the lid member 38 is attached to the opening portion 51. Note that a rubber member or spring may be provided as the elastic member instead of the sponge member 73.

In the printer with the configuration described above, when the RFID tag 31 is inserted into the storage unit 42 and the lid member 38 is attached to the opening portion 51, the sponge member 73 pushes the rear edge 76 of the RFID tag 31 in the insertion direction. Accordingly, the sponge member 73 restricts the movement of the RFID tag 31.

As described above, in the fourth embodiment, the sponge member 73 restricts the movement of the RFID tag 31. Accordingly, it is possible to reduce wobble of the RFID tag 31 in a space between the RFID tag 31 and the lid member 38.

Fifth Embodiment

A fifth embodiment of the present invention will be explained next. In the description below, elements in the fifth embodiment same as those in the first and second embodiments are designated by same reference numerals, and explanations thereof are omitted. The elements same as those in the first and second embodiments provide same effects.

Figure 22:
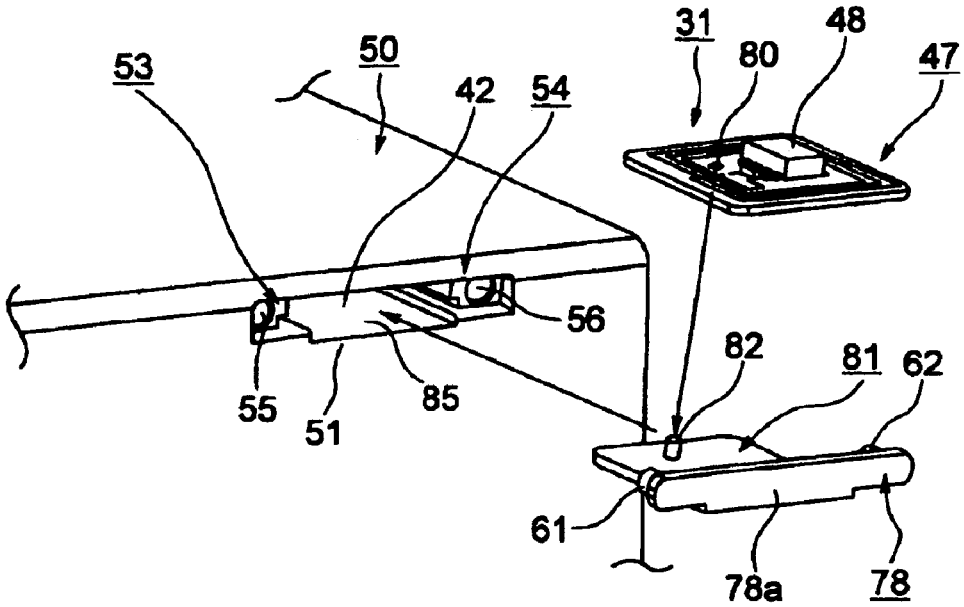
FIG. 22 is a schematic exploded perspective view showing a method of attaching the RFID tag according to a fifth embodiment of the present invention.
Figure 23:
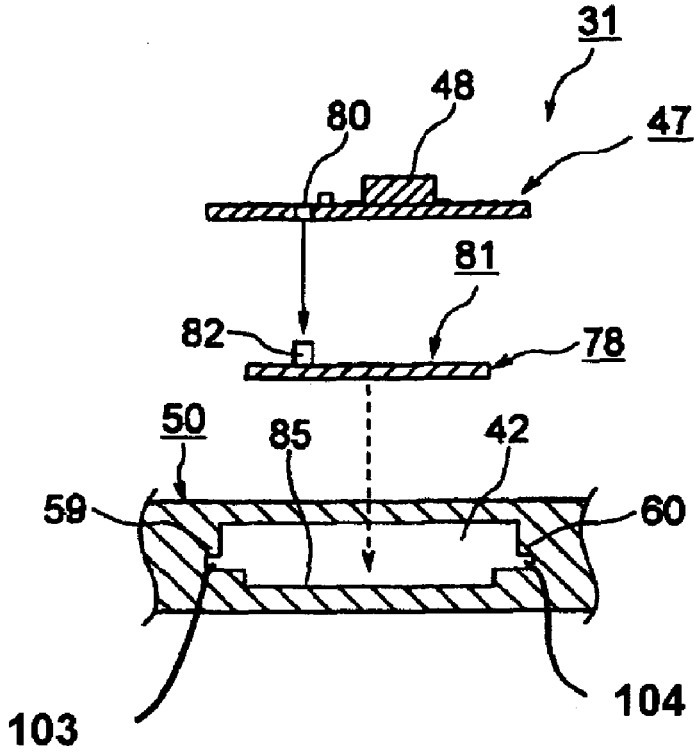
FIG. 23 is a schematic sectional view showing the method of attaching the RFID tag according to the fifth embodiment of the present invention.
Figure 24:
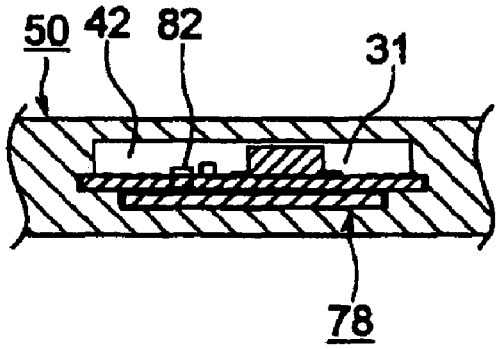
FIG. 24 is a schematic sectional view showing an attachment state of the RFID tag according to the fifth embodiment of the present invention.

FIG. 22 is a schematic exploded perspective view showing a method of attaching the RFID tag 31 according to the fifth embodiment of the present invention. FIG. 23 is a schematic sectional view showing the method of attaching the RFID tag 31 according to the fifth embodiment of the present invention. FIG. 24 is a schematic sectional view showing an attachment state of the RFID tag 31 according to the fifth embodiment of the present invention As shown in FIGS. 22 to 24, a lid member 78 includes a lid member main body 78*a* and a tag supporting member 81 as a supporting member protruding forward from the lid member main body 78*a* and extending in parallel to the RFID tag 31. In a state of being supported on the tag supporting member 81 of the lid member 78, the RFID tag 31 is inserted into the storage unit 42 together with the tag supporting member 81, and the lid member main body 78*a* closes the opening portion 51.

The tag supporting member 81 is provided with a pin 82 as an engaging portion at a specific position for positioning the RFID tag 31 relative to the tag supporting member 81. Further, the base member 47 is provided with a pin hole 80 as an engaging portion at a position corresponding to the pin 82 for receiving the pin 80. Accordingly, the RFID tag 31 is attached to the tag supporting member 81 through the engagement of the pin 82 and the pin hole 80.

The guide ribs 59 and 60 are situated inside the storage unit 42 as the fixing portions along both sidewalls of the storage unit 42. The outer portions of the base member 47 outside the antenna circuit pattern 49 are inserted into the grooves 103 and 104 formed below the guide ribs 59 and 60, thereby fixing and supporting the RFID tag 31 inside the storage unit 42. A groove 85 is formed at a bottom portion of the storage unit 42 for holding the tag supporting member 81 when the lid member 78 is inserted. The groove 85 has a depth larger than a thickness of the tag supporting member 81.

The pin 82 is inserted into the pin hole 80, and the RFID tag 31 is placed on the tag supporting member 81. Then, the lid member 78 is inserted into the storage unit 42 together with the RFID tag 31, and the lid member main body 78*a* closes the opening portion 51.

As described above, in the fifth embodiment, the RFID tag 31 is supported with the lid member 78. Accordingly, it is possible to reduce wobble of the RFID tag 31 relative to the main body of the toner cartridge 21Bk in all directions such as the insertion direction, a width direction of the opening portion, and a vertical direction. As a result, it is possible to accurately position the RFID tag 31 relative to the toner cartridge 21Bk.

When the pin 82 has an outer diameter substantially same as an inner diameter of the pin hole 80, it is possible to firmly fit the pin 82 into the pin hole 80. Accordingly, it is possible to accurately position the RFID tag 31 relative to the lid member 78.

Sixth Embodiment

Figure 25:
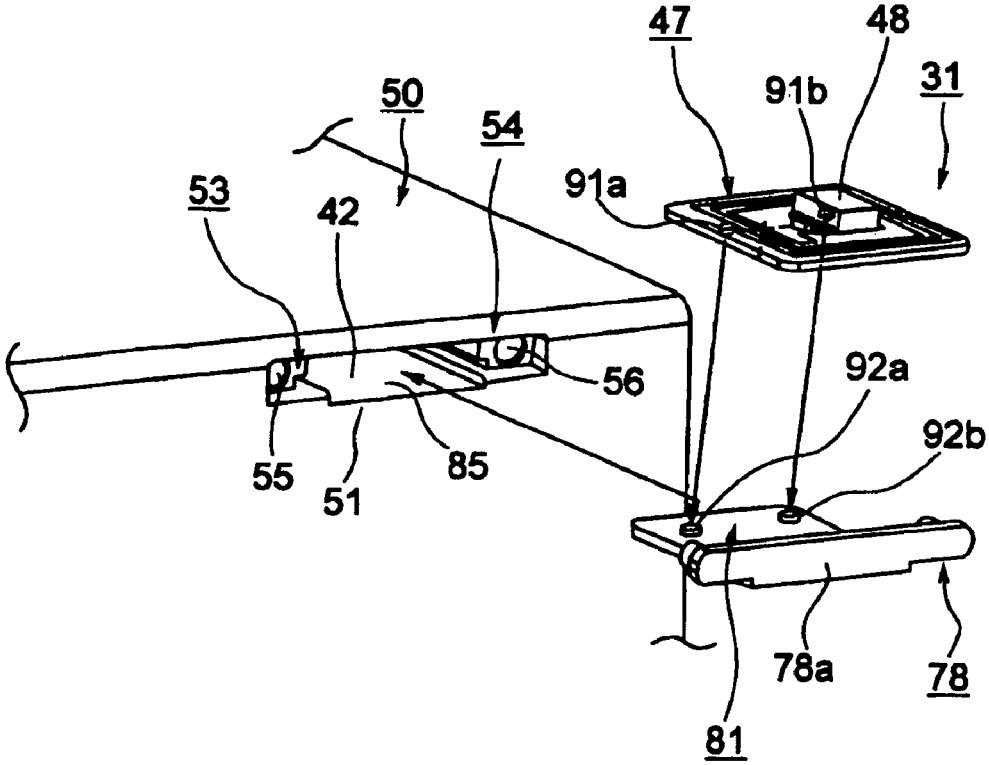
FIG. 25 is a schematic exploded perspective view showing a method of attaching the RFID tag according to a sixth embodiment of the present invention.
Figure 26:
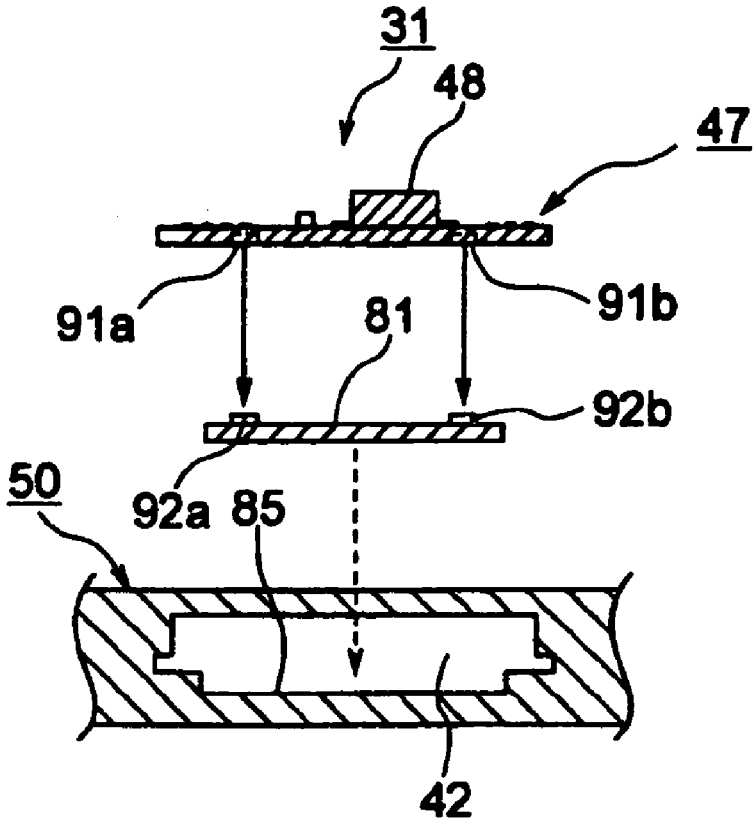
FIG. 26 is a schematic sectional view showing the method of attaching the RFID tag according to the sixth embodiment of the present invention.
Figure 27:
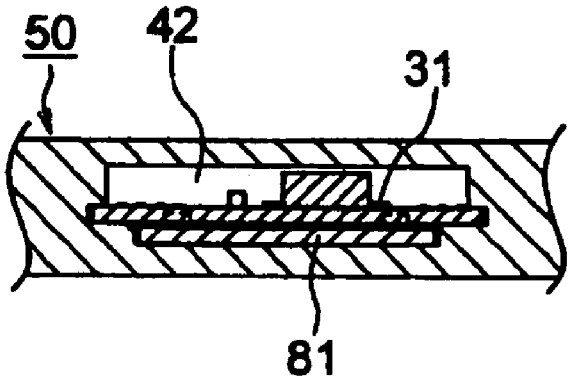
FIG. 27 is a schematic view showing an attachment state of the RFID tag according to the sixth embodiment of the present invention.

A sixth embodiment of the present invention will be explained next. In the sixth embodiment, a plurality of pins and a plurality of pin holes are provided. FIG. 25 is a schematic exploded perspective view showing a method of attaching the RFID tag 31 according to the sixth embodiment of the present invention. FIG. 26 is a schematic sectional view showing the method of attaching the RFID tag 31 according to the sixth embodiment of the present invention. FIG. 27 is a schematic view showing an attachment state of the RFID tag 31 according to the sixth embodiment of the present invention.

In the sixth embodiment, the tag supporting member 81 is provided with pins 92*a* and 92*b* as engaging portions, and the base member 47 is provided with pin holes 91*a* and 91*b* as engaging portions. The pins 92*a* and 92*b* are inserted into the pin holes 91*a* and 91*b* up to a middle point in a thickness direction of the base member 47, and do not pass all the way through the pin holes 91*a* and 91*b*.

In the sixth embodiment, two of the pins 92*a* and 92*b* and two of the pin holes 91*a* and 91*b* are provided. The numbers of the pins and the pin holes are not limited thereto, and may be three or more. When a large number of pins and pin holes, it is possible to position the RFID tag 31 relative to the lid member 78 more accurately.

In the sixth embodiment, the pin holes 91*a* and 91*b* are formed in the base member 47 up to a middle point in the thickness direction thereof. Accordingly, it is not necessary to form the pin holes 91*a* and 91*b* in an area on the base member 47 other than the memory element 48 and the antenna circuit pattern 49, thereby alleviating design restriction. As a result, it is possible to freely dispose an arbitrary number of the pins and pin holes, or to increase the number of the pins and pin holes.

In the embodiments described above, the printer is explained as the image forming apparatus, and the present invention is applicable to a copier, a facsimile, a combination device, and the likes.

The disclosure of Japanese Patent Application No. 2006-018676, filed on Jan. 27, 2006, is incorporated in the application.

While the invention has been explained with reference to the specific embodiments of the invention, the explanation is illustrative and the invention is limited only by the appended claims.

What is claimed is:

1. An exchange unit to be detachably attached to an electric apparatus, comprising:

an information holding unit for communicating with a communication unit disposed in the electric apparatus to read or write information, said information holding unit including a base member with a memory element;

a housing unit having an opening portion in a first surface thereof adjacent to a second surface thereof facing the communication device;

a storage unit for retaining the information holding unit, said storage unit extending from the opening portion along the second surface in parallel to the base member; and a lid member for opening and closing the opening portion.

2. The exchange unit according to claim 1, wherein said lid member is detachably attached to the housing unit.

3. The exchange unit according to claim 1, wherein said housing unit further includes a sidewall adjacent to a surface facing the communication device, said sidewall having the opening portion.

4. The exchange unit according to claim 1, wherein said base member further includes a circuit pattern formed thereon, said housing unit further including a fixing portion for holding a portion of the base member where the circuit pattern is not formed to fix the information holding unit.

5. The exchange unit according to claim 1, wherein said lid member includes a deformable member on an inner portion thereof.

6. The exchange unit according to claim 1, wherein said lid member includes a supporting portion for supporting the information holding unit, said supporting portion having a first engaging portion for engaging a second engaging portion formed on the information holding unit so that the information holding unit is detachably attached to the supporting portion.

7. The exchange unit according to claim 1, wherein said lid member is formed of a part of the housing unit.

8. The exchange unit according to claim 1, further comprising a developer storage unit for storing developer so that the exchange unit functions as a toner cartridge.

9. The exchange unit according to claim 1, further comprising a developer supporting member for supporting developer on a surface thereof and a developer supply member for supplying the developer to the developer supporting member so that the exchange unit functions as an image forming unit.

10. The exchange unit according to claim 1, further comprising a fixing device and a heating unit for heating the fixing device so that the exchange unit functions as a fixing unit.

11. An image forming apparatus comprising the exchange unit according to claim 1 detachably attached thereto.

12. The exchange unit according to claim 4, wherein said storage unit has a height greater than that of the information holding unit.

13. The exchange unit according to claim 4, wherein said storage unit includes two end portions, said opening portion being situated at one of the two end portions, a rear surface being situated at the other of the two end portions, said fixing portion being formed of a guide rib extending from the opening portion to the rear surface along the second surface so that the information holding unit is inserted into a groove formed between the guide rib and a bottom surface of the storage unit.

14. The exchange unit according to claim 13, wherein said guide rid has a height i (mm) and said storage unit has a thickness j (mm) so that the following relationship is established:

$$j \leqq i \leqq j + 0.2 \text{ mm}.$$

15. The exchange unit according to claim 13, wherein said storage unit has a width f (mm) and said information holding unit has a width g (mm) so that the following relationship is established:

$$g \leqq f \leqq g + 0.5 \text{ mm}.$$

16. The exchange unit according to claim 13, wherein said storage unit has a distance d (mm) between the opening portion and the rear surface equal to or greater than a length e (mm) of the information holding unit.

17. The exchange unit according to claim 16, wherein said lib unit has a thickness k (mm) so that the following relationship is established:

$$(d-e)-0.5\ \text{mm} \leqq k \leqq (d-e).$$

18. The exchange unit according to claim 13, wherein said circuit pattern is formed in a spiral shape surrounding the memory element.

19. The exchange unit according to claim 18, wherein guide rib has a width greater than a distance between an end portion of the information holding unit and an outermost portion of the circuit pattern.

* * * * *